US010867758B2

(12) United States Patent
Bianco et al.

(10) Patent No.: US 10,867,758 B2
(45) Date of Patent: Dec. 15, 2020

(54) SWITCHING DEVICE

(71) Applicant: ABB Schweiz AG, Baden (CH)

(72) Inventors: Andrea Bianco, Sesto San Giovanni (IT); Roberto Penzo, Milan (IT); Carlo Boffelli, Dalmine (IT)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/566,124

(22) Filed: Sep. 10, 2019

(65) Prior Publication Data

US 2020/0083001 A1 Mar. 12, 2020

(30) Foreign Application Priority Data

Sep. 11, 2018 (EP) ..... 18193805

(51) Int. Cl.
*H01H 1/36* (2006.01)
*H01H 9/02* (2006.01)
(Continued)

(52) U.S. Cl.
CPC ..... *H01H 9/541* (2013.01); *H01H 3/54* (2013.01); *H01H 9/0044* (2013.01)

(58) Field of Classification Search
USPC ..... 307/113
See application file for complete search history.

(56) References Cited

U.S. PATENT DOCUMENTS

2012/0285806 A1* 11/2012 Boffelli ..... H01H 9/542 200/48 R

FOREIGN PATENT DOCUMENTS

DE 4341158 A1 6/1994
EP 2523203 A1 11/2012
(Continued)

OTHER PUBLICATIONS

European Patent Office, Search Report issued in corresponding Application No. 18193805.1, dated Feb. 28, 2019, 5 pp.

*Primary Examiner* — Rexford N Barnie
*Assistant Examiner* — Xuan Ly
(74) *Attorney, Agent, or Firm* — Taft Stettinius & Hollister LLP; J. Bruce Schelkopf

(57) ABSTRACT

A switching device for low or medium voltage electric power distribution network, the switching device including one or more electric poles, each electric pole including: an insulating housing extending along a longitudinal axis and fixed to a main support structure of the switching device; a first pole terminal and a second pole terminal electrically connectable with a corresponding phase conductor of an electric power source and with a corresponding load conductor of an electric load, respectively; a movable contact and a fixed contact, which are electrically coupleable or decoupleable one with or from another upon a movement of the movable contact towards or away from the fixed contact, the fixed contact being electrically connected with the first pole terminal, the movable contact being electrically connectable with the second pole terminal; a movable circuit assembly including a plurality of semiconductor devices adapted to switch in a conduction state or in an interdiction state depending on the voltage applied thereto, the semiconductor devices being electrically connected in series one to another in such a way that a current can flow according to a predefined conduction direction when the semiconductor devices are in a conduction state, the movable circuit assembly including first and second assembly terminals for the plurality of semiconductor devices. The movable circuit assembly is operatively coupled with the movable contact and moves together with the movable contact during a movement of the movable contact towards or away from the (Continued)

Figure 1:
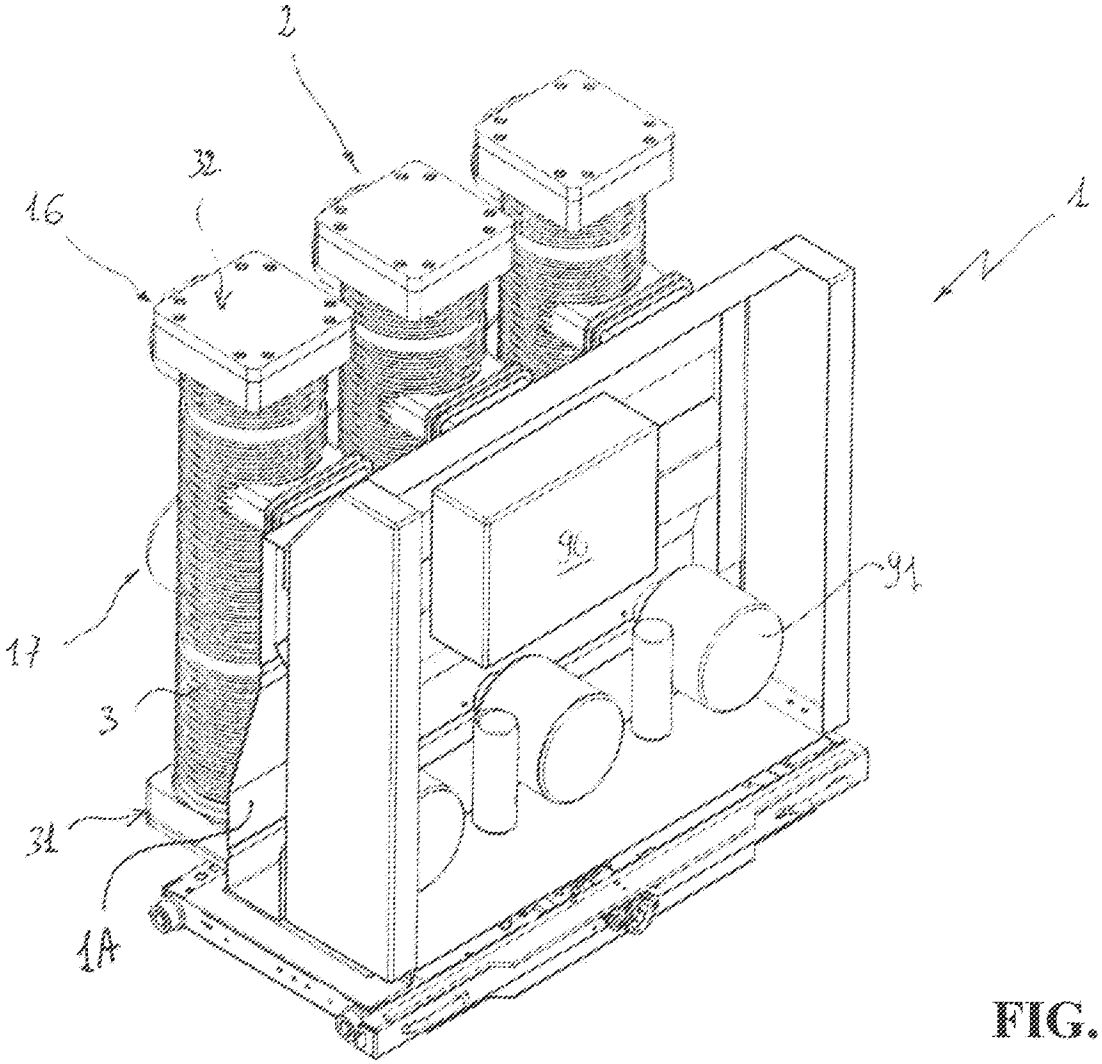

fixed contact, the semiconductor devices switching in a conduction on state or in an interdiction state depending on the position of the movable contact.

20 Claims, 11 Drawing Sheets

(51) Int. Cl.

| | |
|---|---|
| ***H01H 9/54*** | (2006.01) |
| ***H01H 3/54*** | (2006.01) |
| ***H01H 9/00*** | (2006.01) |

(56) References Cited

FOREIGN PATENT DOCUMENTS

| | | | |
|---|---|---|---|
| WO | 02093600 | A1 | 11/2002 |
| WO | 2017005474 | A1 | 1/2017 |

* cited by examiner

SWITCHING DEVICE

The present invention relates to the field of switchgears for low or medium voltage electric power distribution networks.

More particularly, the present invention relates to an improved switching device for low or medium voltage electric power distribution networks.

In a further aspect, the present invention relates to a switchgear including the aforesaid switching device.

Within the framework of the present invention, the term "low voltage" (LV) relates to nominal operating voltages lower than 1 kV AC and 1.5 kV DC whereas the term "medium voltage" (MV) relates to nominal operating voltages higher than 1 kV AC and 1.5 kV DC up to some tens of kV, e.g. up to 72 kV AC and 100 kV DC.

As is known, switching devices are installed in electric power distribution networks for connecting/disconnecting an electric power source (e.g. a power line) with or from one or more associated electrical loads.

A traditional switching device comprises one or more electric poles, each having a movable contact movable between a first operating position, at which it is coupled to a corresponding fixed contact, and a second operating position, at which it is decoupled from the fixed contact. Each electric pole is electrically connected to an electric power line and the associated electrical loads, in such a way that a current can flow between the power line and the electric loads passing through a main conduction path provided by the coupled fixed and movable contacts.

On the other hand, the current flowing between the electric line and the electric loads is interrupted when the movable contacts of the switching device are decoupled from the corresponding fixed contacts, for example in case of faults.

In some switching devices of the state of the art (such those disclosed in patent document EP2523203 and WO2017/005474A1), each electric pole is provided with a number of semiconductor devices (typically power diodes) configured to allow the passage of currents flowing according to a predetermined direction only.

Such semiconductor devices are arranged to allow or block the passage of a currents flowing along an auxiliary conduction path, which is electrically connected in parallel with the aforesaid main conduction path.

As is known, in these switching devices, a suitable synchronization of the movements of the movable contacts with the waveforms of the electric line voltage and of the load current allows reducing remarkable parasitic phenomena, such as the generation of electrical arcs during opening manoeuvres (when the electric power line is disconnected from an electric load, e.g. a bank of capacitors). On the other hand, it allows limiting possible inrush currents and transient over-voltages generated during closing manoeuvres (when the electric line electrically couples with said electric load).

Unfortunately, switching devices of the above-mentioned type have some critical aspects.

In order to limit the size of the electric poles, power diodes with small size, which cannot withstand operating voltages above a given threshold value (typically about 1 kV for standard devices) are normally adopted.

As the nominal operating voltages in the electric poles may reach some tens of kV, a large number of power diodes have to be employed.

However, this may make difficult the synchronization of the movements of the movable contacts with the waveforms of the electrical quantities related to the electric poles, in particular during the opening manoeuvres of the switching device.

As is known, such a difficult synchronization may lead to the formation of micro-arcs between the electric contacts, which have been proven to remarkably reduce the operating life of the electric contacts.

Additionally, these switching devices cannot normally withstand high current levels, e.g. in the order of tends of kA. As is obvious, this remarkably limits their use in electric power distribution networks, as they generally cannot provide short-circuit switching capabilities.

The main aim of the present invention is to provide a switching device for LV or MV electric power distribution networks, which allows overcoming the drawbacks of the known art.

Within this aim, a purpose of the present invention is to provide a switching device showing improved performances in terms of reduction of parasitic phenomena during the opening/closing manoeuvres.

A further purpose of the present invention is to provide a switching device showing improved switching performances, even when short-circuit currents are present.

A further purpose of the present invention is to provide a switching device having electric poles with a compact and robust structure.

A further purpose of the present invention is to provide a switching device relatively simple and cheap to be manufactured at industrial levels.

The above aim and purposes, as well as other purposes that will emerge clearly from the following description and attached drawings, are provided according to the invention by a switching device for LV or MV electric power distribution networks, according to the following claim 1 and the related dependent claims.

In a further aspect, the present invention provides a switchgear for LV or MV installations, according to the following claim 13.

Figure 2:
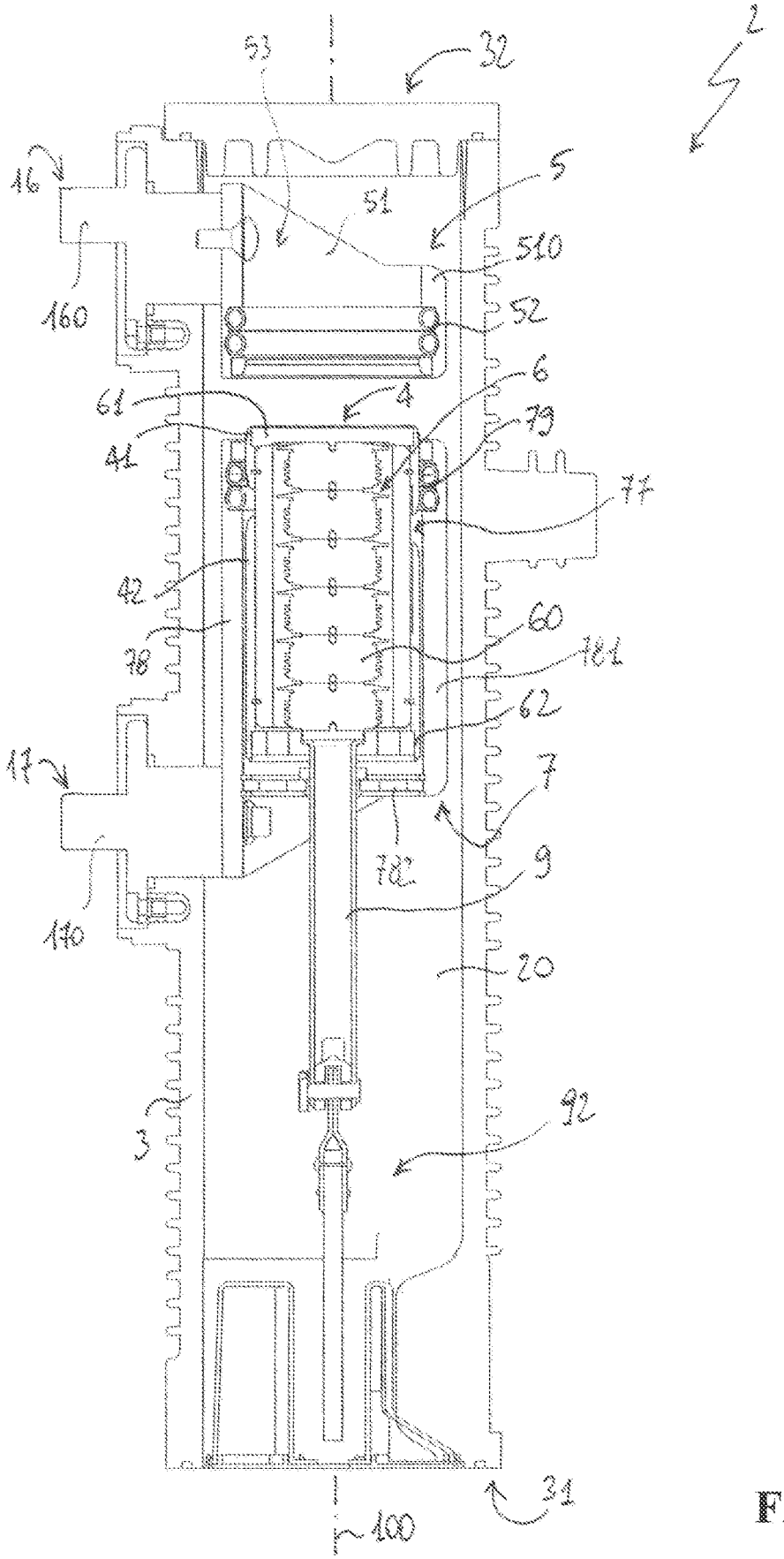
Figure 3:
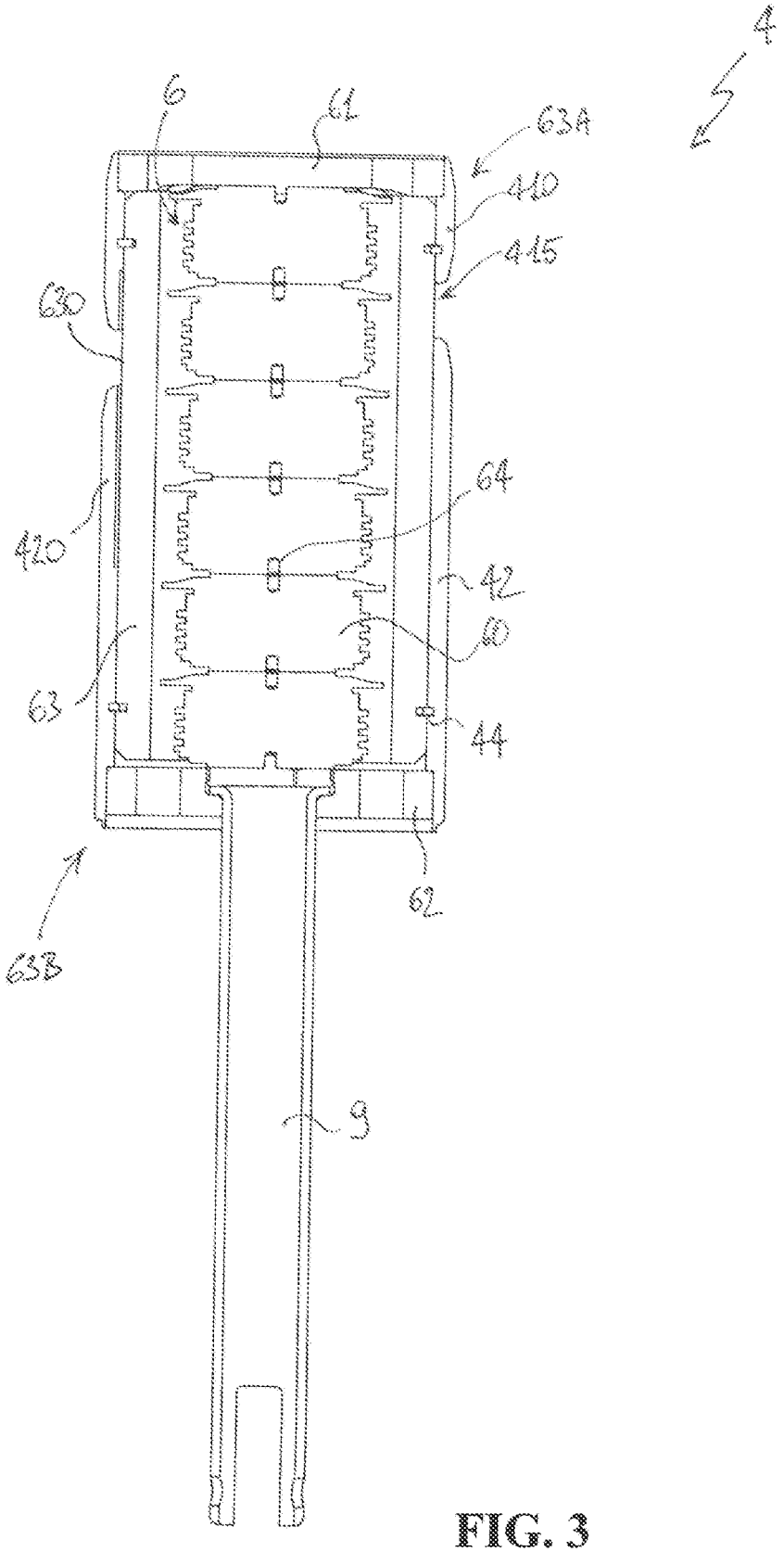
Figure 4:
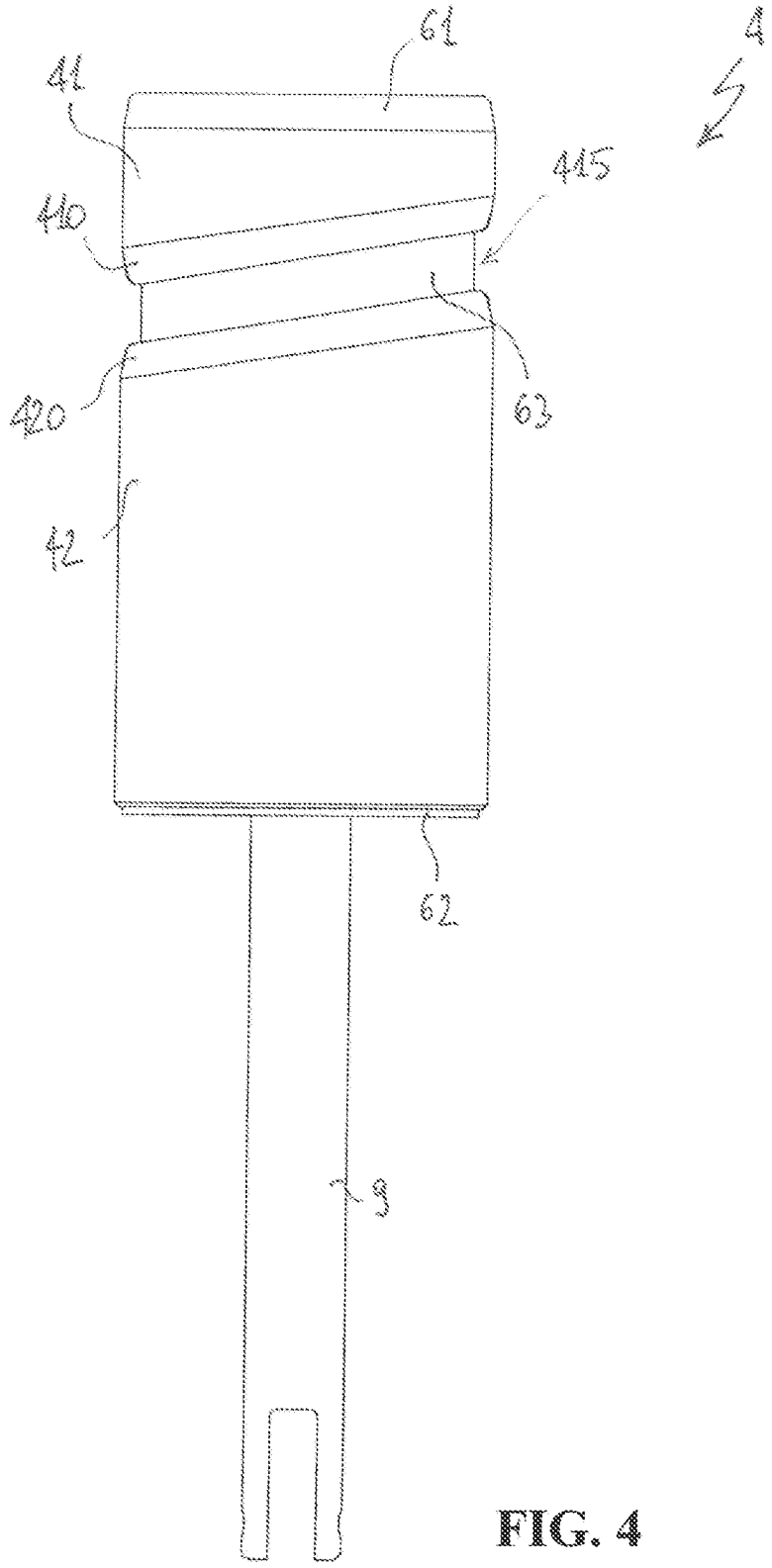
Figure 5:
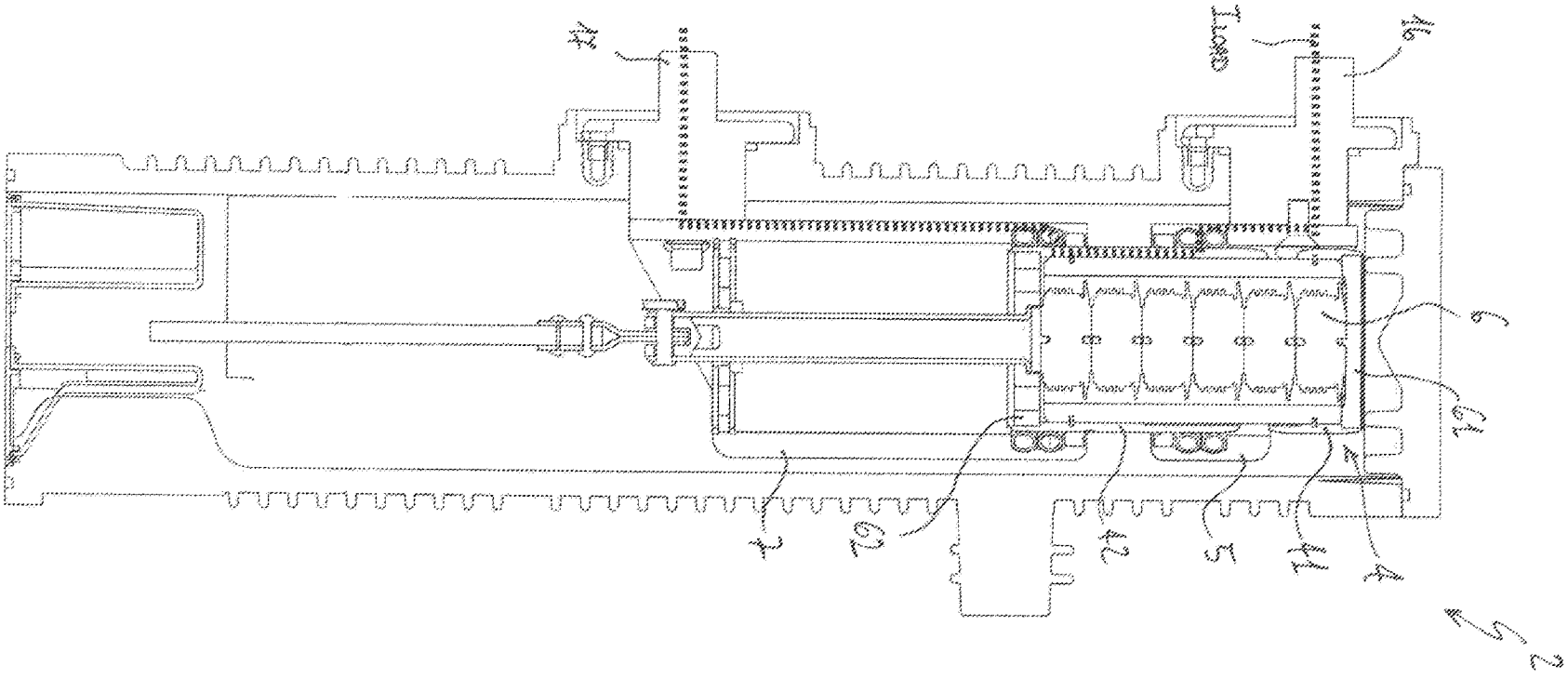
Figure 6:
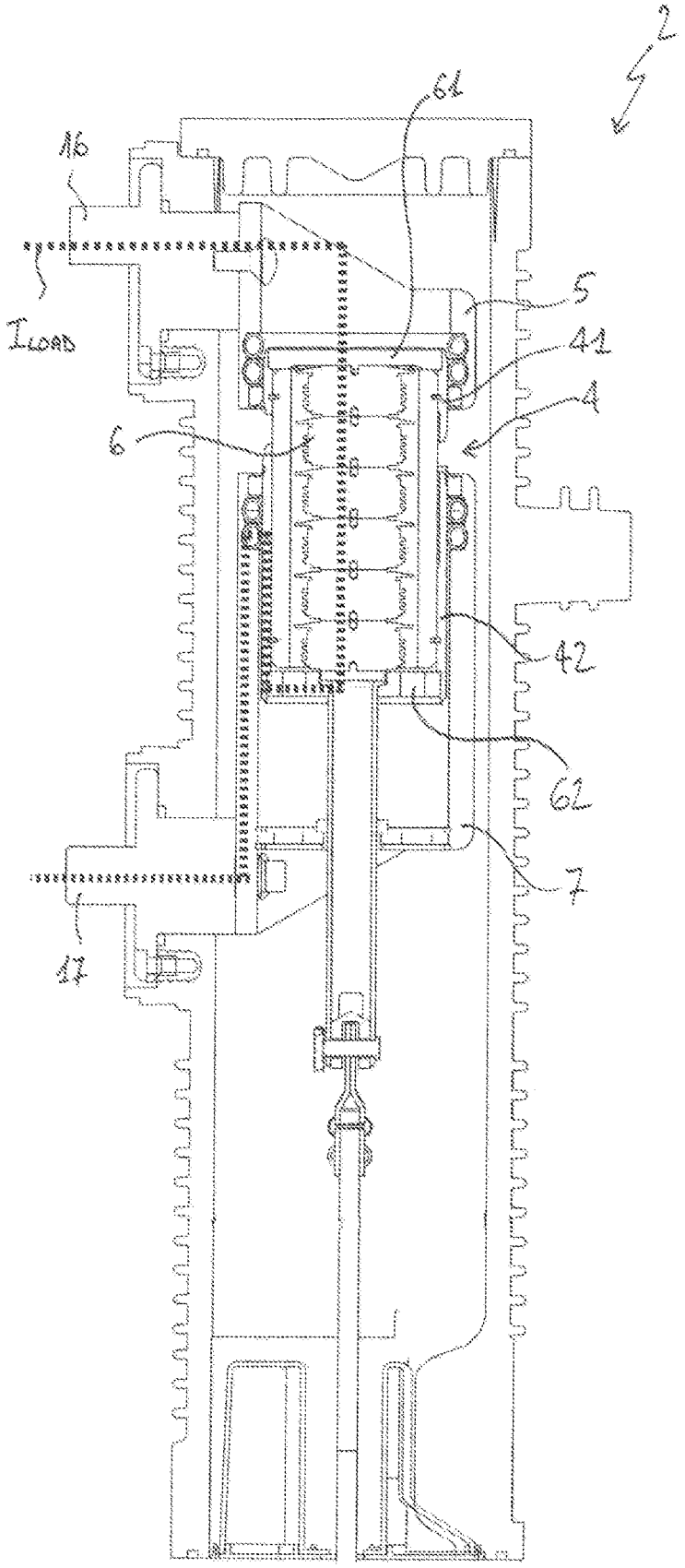
Figure 7:
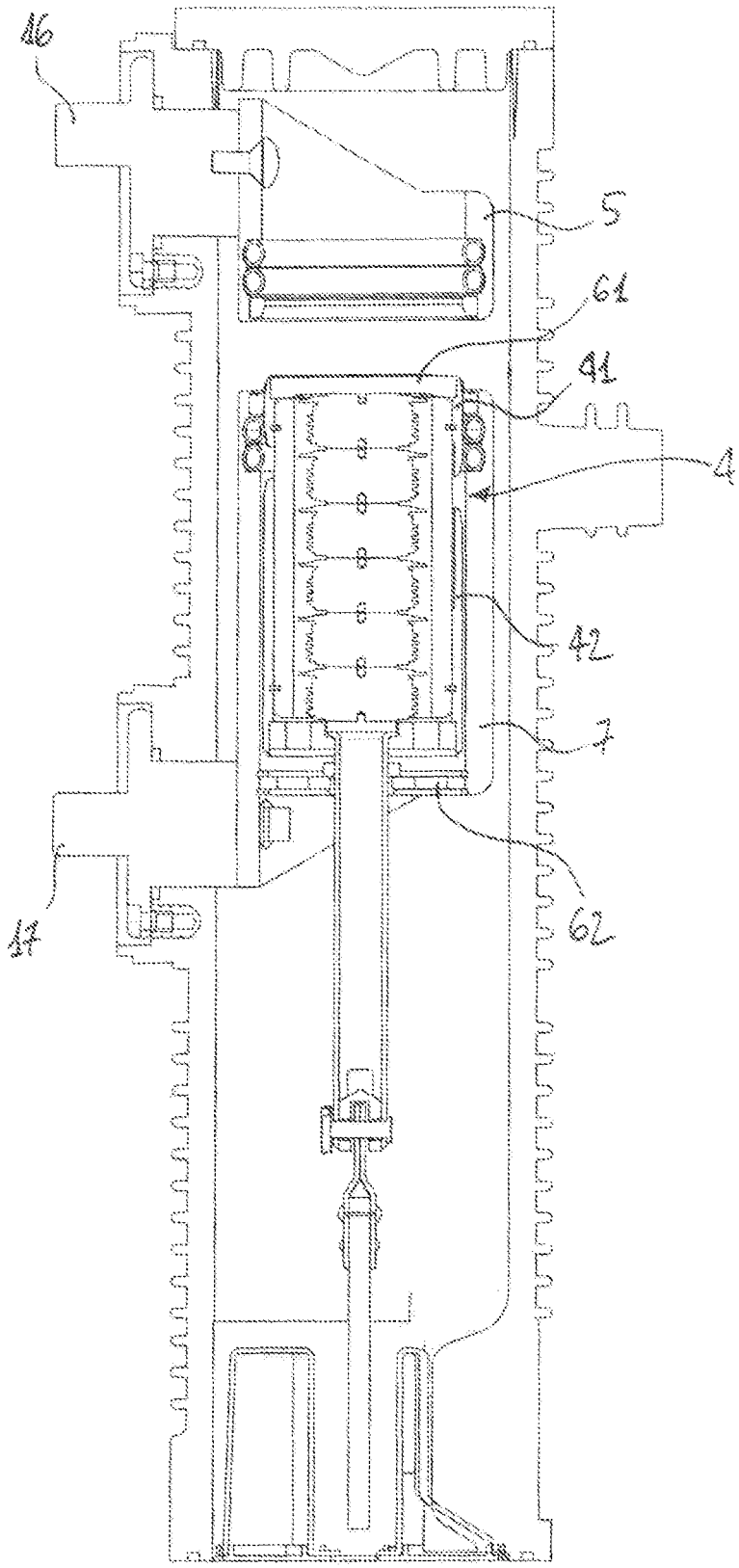

Characteristics and advantages of the present invention will become more apparent from the detailed description of preferred embodiments illustrated only by way of non-limitative example in the accompanying drawings, in which:

FIG. 1 schematically shows the switching device, according to the invention;

FIG. 2 schematically shows section views of an electric pole of the switching device, according to an embodiment of the invention;

FIGS. 3-4 schematically show a movable contact included in the switching device, according to an embodiment of the invention;

FIGS. 5-7 schematically show section views of an electric pole of the switching device, according to an embodiment of the invention, in different operating conditions;

FIGS. 8-11 schematically show operation of the electric poles of the switching device, according to the invention.

Referring to the cited figures, the present invention relates to a switching device 1.

The switching device 1 is particularly adapted for use in MV electric power distribution networks and it will be described hereinafter with reference to such specific application. However, the switching device 1 may be conveniently used also in LV electric power distribution networks.

Figure 8:
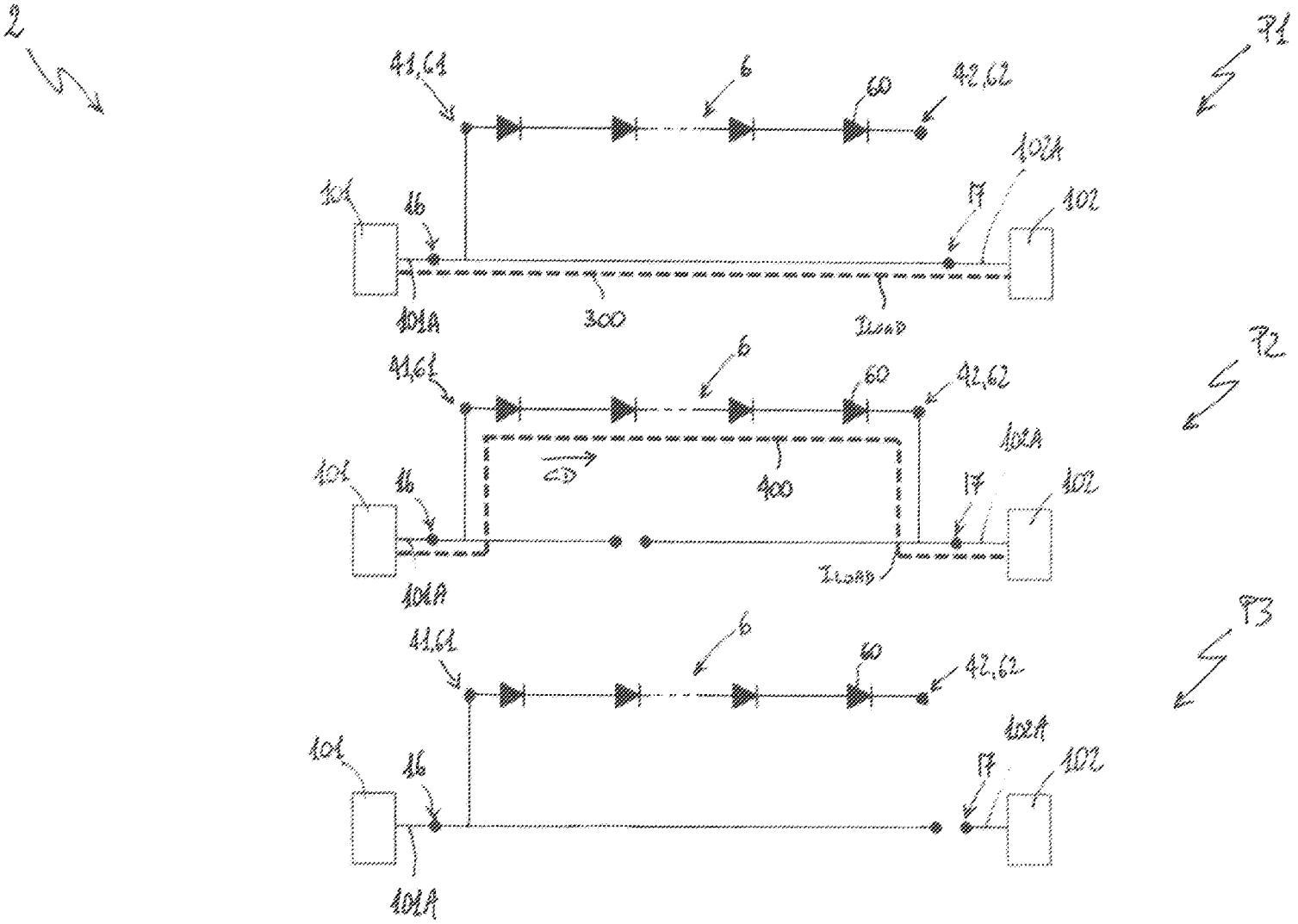

The switching device 1 is adapted to electrically connect or disconnect an electric power source 101 (e.g. a power line) with or from one or more associated electric loads 102 (FIG. 8).

The switching device 1 is particularly adapted to feed capacitive loads and it will be described hereinafter with reference to such specific application. In principle, however, the electric loads 102 may be of any type.

The switching device 1 comprises one or more electric poles 2 (for example three as shown in FIG. 1).

Each electric pole 2 is electrically connected to a corresponding phase conductor 101A of the electric power source 101 and to a corresponding load conductor 1021 of an associated electrical load 102 (FIG. 8).

Conveniently, each electric pole 2 comprises an insulating housing 3 defining an internal volume 20 in which a number of components of said electric pole are accommodated.

The housing 3 conveniently extends along a longitudinal axis 100, preferably with a cylinder-like shape, and it has opposite bottom end 31 and top end 32.

Preferably, the housing 3 is fixed to a main support structure 1A of the switching device 1 at its bottom end 31.

Conveniently, the housing 3 is made of an electrically insulating material, which may be of known type.

Each electric pole 2 comprises a first pole terminal 16 and a second pole terminal 17.

The first pole terminal 16 is electrically connectable with a corresponding phase conductor 101A of the electric power source 101 while the second pole terminal is electrically connectable with a corresponding load conductor 102A of the electric load 102 (FIG. 8).

Preferably, the pole terminals 16, 17 are formed by corresponding shaped conductive bodies 160, 170 mechanically fixed to the housing 3 of the electric pole (FIG. 2).

Each electric pole 2 comprises a movable contact 4 and a fixed contact 5.

The movable contact 4 and the fixed contact 5 can be mutually coupled or decoupled.

When the electric contacts 4, 5 are coupled, the switching device 1 is in a closed condition, whereas, the electric contacts 4, 5 are decoupled, the switching device 1 is in an open condition. The moving contact 4 is adapted to move for (mechanically and electrically) coupling with or decoupling from the fixed contact 5 during a switching manoeuvre of the switching device 1. During a closing manoeuvre of the switching device 1, the movable contact 4 moves towards the fixed contact 5 to couple with this latter and establish an electrical continuity between the pole terminals 16, 17 along a main conduction path 300 (FIG. 8).

During an opening manoeuvre of the switching device 1, the movable contact 4 moves away from the fixed contact 5 to decouple from this latter and interrupt the electrical continuity between the pole terminals 16, 17.

Preferably, the movable contact 4 moves linearly substantially along the longitudinal axis 100 of the electric pole 2.

Preferably, during the switching manoeuvres of the switching device, the movable contact 4 is supported and actuated by an actuating rod 9 made of electrically insulating material.

Preferably, as shown in FIG. 1, each electric pole 2 comprises actuation means 91 (e.g. an electric motor) and mechanical connection means 92 (e.g. a kinematic chain including the actuating rod 9) to actuate the movable contacts 4 during a switching manoeuvre of the switching device 1.

According to alternative embodiments, however, the switching device 1 may be equipped with centralized actuation means adapted to actuate the movable contacts 4 of all the electric poles 2 installed in the switching device.

Preferably, the switching device 1 comprises control means 96 (e.g. including one or more microprocessors) for controlling operation of the actuation means 91 and, possibly, additional functionalities of the switching device 1.

In general, the movable contact 4 is electrically connectable with the second pole terminal 17 during a switching manoeuvre of the switching device 1.

Depending on its arrangement (e.g. shape) and stroke, the movable contact 4 may be permanently coupled (in a sliding manner) with the pole terminal 17 or come in contact with this latter during a switching manoeuvre.

Preferably, each electric pole 2 comprises a sliding connection assembly 7 adapted to electrically couple the movable contact 4 with said the pole terminal 17, e.g. during a movement of said movable contact towards or away from the fixed contact 5.

Preferably, the sliding connection assembly 7 comprises a conductive body 78 (e.g. having a cup-like shape) fixed to the second pole terminal 17 and having a cavity 77 defining a volume in which the movable contact 4 can move during a switching operation of the switching device (FIG. 2).

The conductive body 78 comprises a bottom wall 782 in distal position with respect to the fixed contact 5 and a lateral wall 781, which define the cavity 77.

The bottom wall 782 is conveniently fitted with a through hole to allow the passage of the actuating rod 9.

In proximal position with respect to the fixed contact 5, the lateral wall 781 is conveniently fitted with one or more contact rings 79 to provide a sliding electrical connection with the movable contact 4, as this latter moves along the cavity 77.

Preferably, the conductive body 78 comprises a pair of contact rings 79 overlapping along a direction parallel to the longitudinal axis 100 and coaxial with this latter axis.

Preferably, the conductive body 78 is mechanically fixed to the conductive body 170 forming the pole terminal 17. As this latter is fixed to the housing 3, the sliding connection assembly 7 may thus be supported in a suitable position within the internal volume 20 of the electric pole, conveniently in proximal position to the bottom end 31 of the housing 3 (with respect to the fixed contact 5).

Preferably, the fixed contact 5 is formed by a conductive body 51 (e.g. having a flanged shape) defining a cavity 53 in which the movable contact 4 can move during a switching operation of the switching device.

At a lateral wall 510 defining the cavity 53, the conductive body 51 is fitted with one or more contact rings 52 to provide a sliding electrical connection with the movable contact 4, when this latter moves along the cavity 53.

Preferably, the conductive body 51 comprises a pair of contact rings 52 overlapping along a direction parallel to the longitudinal axis 100 and coaxial with this latter axis.

In general, the fixed contact 5 is electrically connected with the pole terminal 16.

Preferably, the conductive body 51 is mechanically fixed to the conductive body 160 forming the pole terminal 16. As this latter is fixed to the housing 3, the fixed contact 5 may thus be supported in a suitable position within the internal volume 20 of the electric pole, conveniently in proximity of the top end 32 of the housing 3.

According to the invention, each electric pole 2 comprises a movable circuit assembly 6 that comprises a plurality of solid-state semiconductor devices 60 and first and second assembly terminals 61, 62 for said plurality of said semiconductor devices.

Preferably, the semiconductor devices 60 are piled one on another to form a stack structure.

The semiconductor devices 60 are adapted to switch in an ON state (conduction state) or in an OFF state (interdiction state) depending on the voltage applied thereon.

Preferably, the semiconductor devices 60 are configured to operate as electric diodes.

Thus, when they switch in an ON state, the semiconductor devices 60 allow the flow of a current according to a predefined conduction direction, whereas, when they switch in an OFF state, the semiconductor devices 60 block the flow of a current passing there through.

The semiconductor devices 60 may be, as non-limiting examples, power diodes (as shown in the cited figures).

The semiconductor device 60 are electrically connected in series one to another to form a chain of semiconductor devices and allow a current to flow according to a predefined conduction direction CD, when they are in an ON state (FIG. 8).

In the embodiments of the invention shown in the cited figures (in which power diodes are used), the semiconductor devices 60 (electrically connected in series) are arranged in such a way to have their anodes and cathodes oriented towards the first assembly terminal 61 and the second assembly terminal 62, respectively.

In one or more electric poles (as shown in the cited figures) of the switching device 1, the stack 6 of semiconductor devices may comprise:

- an initial semiconductor device 60 having an anode terminal coupled with the first assembly terminal 61 and having a cathode terminal electrically and mechanically coupled with the anode terminal of an adjacent semiconductor device;
- a final semiconductor device 60 having an anode terminal coupled with the cathode terminal of an adjacent semiconductor device and a cathode terminal electrically and mechanically, coupled with the second assembly terminal 62;
- possible one or more intermediate semiconductor devices 60, each intermediate semiconductor device having an anode terminal coupled with a cathode terminal of an adjacent semiconductor device and having a cathode terminal electrically and mechanically coupled with an anode terminal of a further adjacent semiconductor device.

However, the stack of semiconductor devices may be arranged with a dual configuration with respect to the configuration shown in the cited figures.

In one or more electric poles (not shown in the cited figures) of the switching device 1, the stack 6 of semiconductor devices may thus comprise:

- an initial semiconductor device having an anode terminal electrically and mechanically coupled with the second assembly terminal 62 and having a cathode terminal electrically and mechanically coupled with the anode terminal of an adjacent semiconductor device;
- a final semiconductor device having an anode terminal electrically and mechanically coupled with the cathode terminal of an adjacent semiconductor device and a cathode terminal electrically and mechanically coupled with the first assembly terminal 61;
- possible one or more intermediate semiconductor devices, each intermediate semiconductor device having an anode terminal electrically and mechanically coupled with a cathode terminal of an adjacent semiconductor device and having a cathode terminal electrically and mechanically coupled with an anode terminal of a further adjacent semiconductor device.

The above-described arrangements of the stack 6 of semiconductor devices may be properly chosen depending on the behaviour of the electric phases of the switch device 1.

Figure 11:
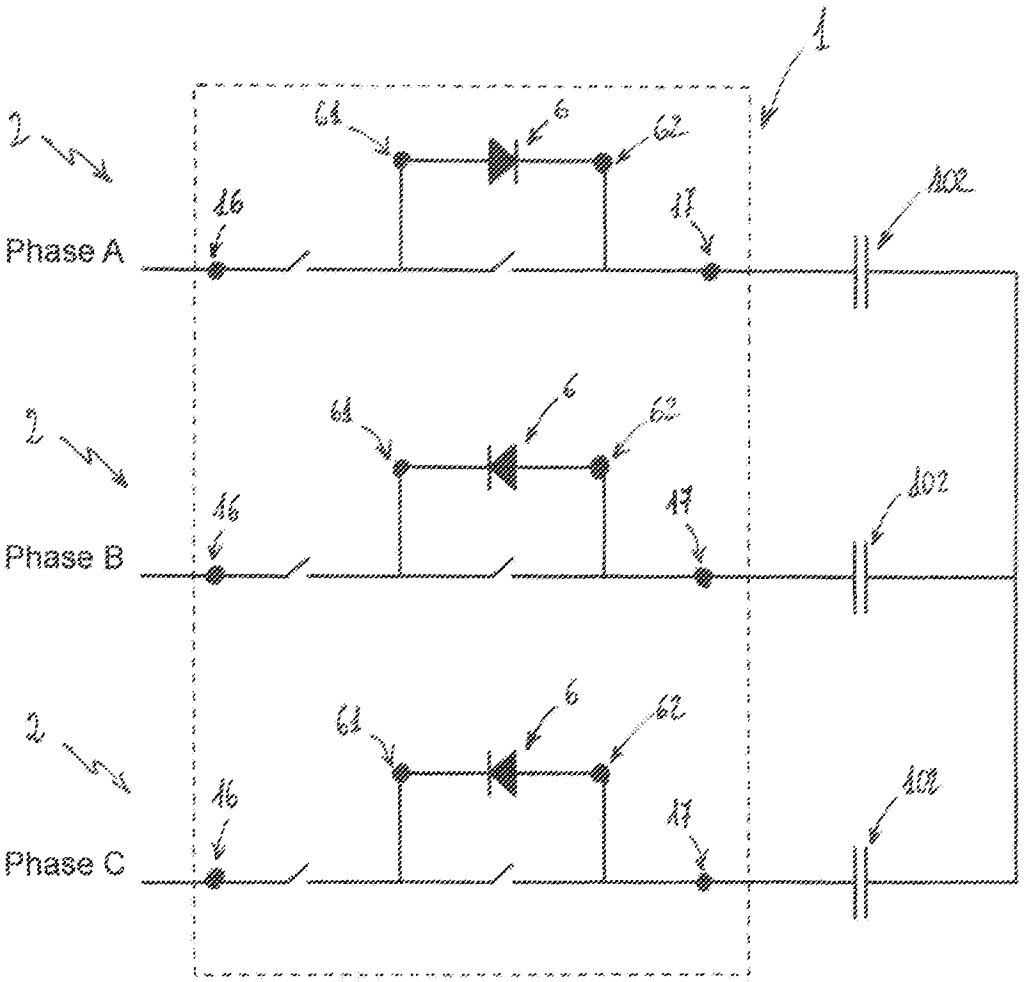

FIG. 11 shows an example of switching device 1, according to the invention, having three electric poles 2 feeding capacitive loads 102. As it is possible to notice, in the electric pole 2 corresponding to the electric phase A, the stack 6 of semiconductor devices is arranged with the configuration shown in the cited figures. Instead, in the electric poles 2 corresponding to the electric phases B and C, the stack 6 of semiconductor devices is arranged with a dual configuration with respect to the one shown in the cited figures. Other arrangements may be suitably designed by the skilled person, according to the needs.

Preferably, as shown in the cited figures, the above-mentioned plurality of semiconductor devices comprises a plurality of intermediate semiconductor devices 60.

Preferably, the circuit assembly 6 comprises connection means 64 to mechanically couple adjacent semiconductor devices 60 and said first and second terminals 61, 62 with a corresponding semiconductor device 60.

Preferably, the connection means 64 comprise a plurality of pins (which may be made in a conductive or plastic material), each of which is adapted to be removably inserted in suitable seats obtained at the anode and cathode terminals of adjacent semiconductor devices 60 and at the first and second assembly terminals 61, 62.

Preferably, the connection means 64 comprise a plurality of conductive pins, each of which is adapted to be removably inserted in suitable seats obtained at the anode and cathode terminals of adjacent semiconductor devices 60 or at the first assembly terminal 61 and the anode terminal of an initial semiconductor device 60 or at the second assembly terminal 62 and the cathode terminal of a final semiconductor device 60 (FIG. 3).

According to the invention, the circuit assembly 6 is operatively coupled with the movable contact 4 to move together with this latter during a switching manoeuvre of the switching device. Conveniently, the semiconductor devices 60 switch in a conduction on state or in an interdiction state depending on the position of the movable contact 4 and the movable circuit assembly 6 during a switching manoeuvre of the switching device (FIG. 8).

In fact, the first and second assembly terminals 61, 62 electrically couple or decouple with or from the fixed contact 5 when the movable contact 4 and the movable circuit assembly 6 reach different positions $P_1$, $P_2$, $P_3$ during a switching manoeuvre of the switching device.

Preferably, the movable contact 4 comprises first and second conductive portions 41, 42 electrically disconnected one from another.

As it will be better seen in the following, the first and second conductive portions 41, 42 are conveniently formed by shaped conductive bodies spaced one from another.

In general, the conductive portions 41, 42 of the movable contact are electrically connected respectively with the first and second assembly terminals 61, 62 of the movable circuit assembly 6.

As an example, the conductive portions 41, 42 can be respectively fixed or made in one piece with the first and second assembly terminals 61, 62 of the movable circuit assembly 6.

The first and second conductive portions 41, 42 are electrically coupleable with or decoupleable from the fixed contact 5 (and possibly the second pole terminal 17) when the movable contact 4 and the movable circuit assembly 6 reach different positions $P_1$, $P_2$, $P_3$ during a switching operation of the switching device (FIG. 8).

Preferably, during a switching operation of the switching device, the movable contact 4 and the movable circuit assembly 6 reach:

- at least a position $P_1$, in which the second conductive portion 42 is coupled with the fixed contact 5 and with the second pole terminal 17 (FIG. 5);
- at least a position $P_2$, in which the first conductive portion 41 is coupled with the fixed contact 5 and is decoupled from said second pole terminal 17 and in which the second conductive portion 42 is coupled with the second pole terminal and is decoupled from the fixed contact 5 (FIG. 6);
- at least a position $P_3$, in which the first and second conductive portions 41, 42 are decoupled from the fixed contact 5 (FIG. 7).

For the sake of clarity, it is evidenced that the aforesaid term "at least a position" may indicate (e.g. depending on the shape of the first and second conductive portions 41, 42) a certain position or a certain range of positions in which given coupling conditions of the first and second conductive portions 41, 42 with the fixed contact 5 (and possibly with the second pole terminal 17) are obtained.

For the sake of clarity, it is evidenced that the aforesaid terms "coupled"/"uncoupled" indicate there is/there is not an electric and mechanical contact between the parts involved.

In general terms, the semiconductor devices 60 switch in an ON state or in an OFF state at different instants during a switching manoeuvre of the switching device as the first and second conductive portions 41, 42 (and, consequently, the first and second assembly terminals 61, 62) are electrically coupleable or decoupleable with or from the fixed contact 5 at different given positions $P_1$, $P_2$, $P_3$ of the movable contact 4 and the movable circuit assembly 6.

The semiconductor devices 60 can thus conveniently form an auxiliary conduction path 400 between the pole terminals 16, 17 in certain operating conditions during a switching operation of the switching device.

Depending on the position of the movable contact 4 and the movable circuit assembly 6 with respect to the fixed contact 5, the auxiliary conduction path 400 may be interrupted or short-circuited.

When the movable contact 4 and the movable circuit assembly 6 are in or reach a first position $P_1$ (FIG. 5), the semiconductor devices 60 are or switch in an OFF state, as the first conductive portion 41 (and consequently the first assembly terminal 61) is decoupled from the fixed contact 5 (and consequently from the first pole terminal 16).

In this case, the auxiliary conduction path 400 is interrupted and no currents pass through the semiconductor devices 60.

The main conduction path 300 instead ensures an electrical continuity between the pole terminals 16, 17 as the fixed contact 5 (and consequently the pole terminal 16) and the second terminal 17 are electrically connected through the second conductive portion 42.

A load current $I_{LOAD}$ passes through the main conduction path 300.

When the movable contact 4 and the movable circuit assembly 6 reach a second position $P_2$ (FIG. 6), the first conductive portion 41 (and consequently the first assembly terminal 61) is coupled with the fixed contact 5 (and consequently the pole terminal 16) and the second conductive portion 42 (and consequently the second assembly terminal 62) is coupled with the pole terminal 17 (FIG. 6).

Figure 9:
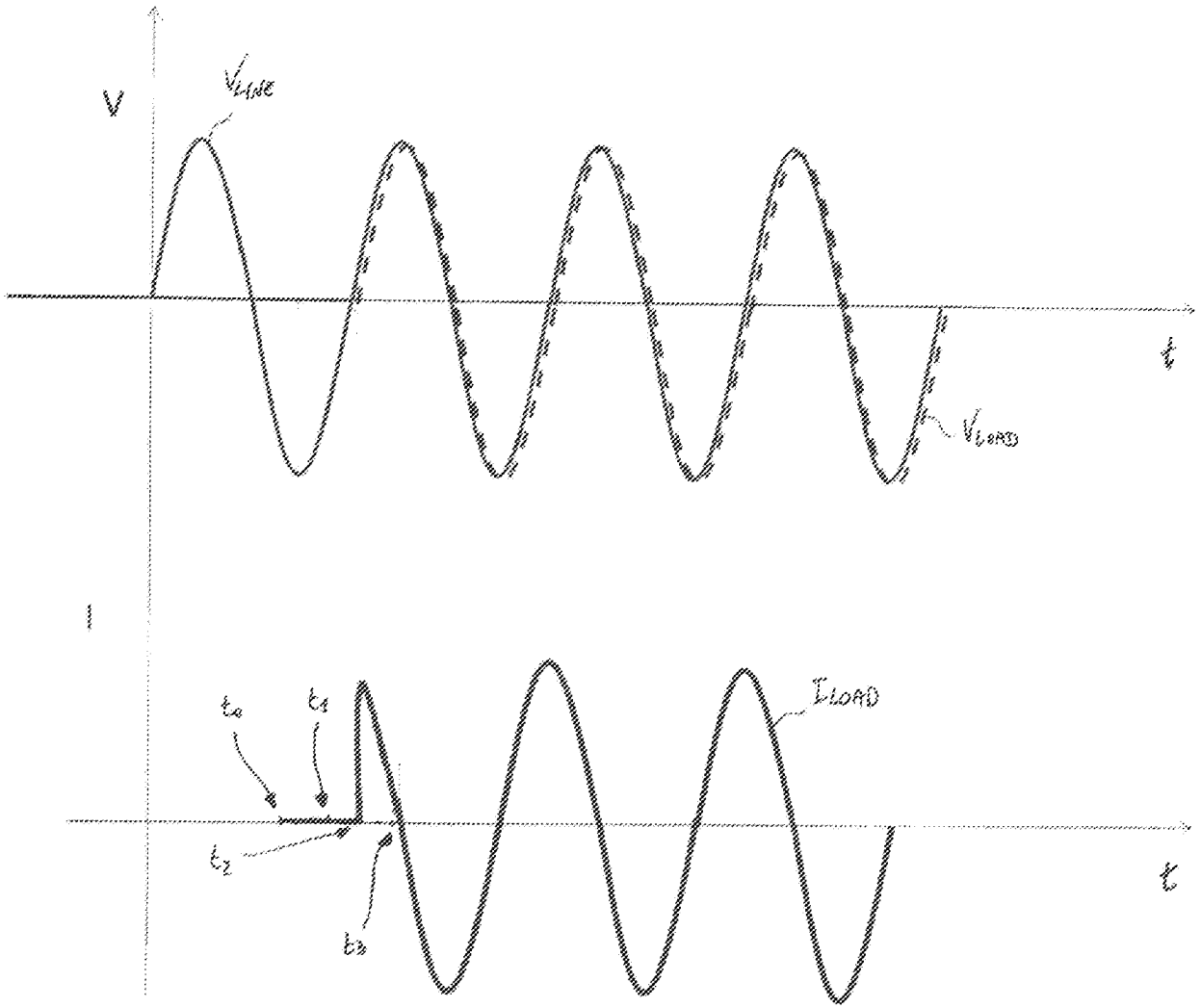

The semiconductor devices 60 switch in an ON state, when a positive voltage higher than a given threshold voltage value is applied between the first and second assembly terminals 61, 62 (FIG. 9). Such a voltage threshold value (e.g. of few volts) depends on the physical characteristics of the semiconductor devices 60 and is typically very smaller than the peak value of the voltage of the electric phase conductor 101A (FIG. 8).

A load current $I_{LOAD}$ passes through the auxiliary conduction path 400, which, in this case, comprises the first conductive portion 41, the first assembly terminal 61, the semiconductor devices 60, the second assembly terminal 62 and the second conductive portion 42.

The main conduction path 300 is interrupted, as the fixed contact 5 and the second conductive portions 42 (and consequently the second assembly terminal 62) are decoupled (FIG. 8).

When the movable contact 4 and the movable circuit assembly 6 are in or reach a third coupling position $P_3$ (FIG. 7), the semiconductor devices 60 switch in an OFF state as the first and second conductive portions 41, 42 (and consequently the first and second assembly terminals 61, 62) are decoupled from the fixed contact 5.

Therefore, no currents pass through the auxiliary conduction path 400.

In addition, the main conduction path 300 is interrupted, as the fixed contact 5 and the movable contact 4 are decoupled (FIG. 8).

FIG. 9 schematically shows an exemplary behaviour of some relevant electrical quantities such as the line voltage $V_{LINE}$ of the electric power source 101, the load voltage $V_{LOAD}$ applied to the electric load 102 (which is supposed to be of capacitive type) and the load current $I_{LOAD}$ passing through the electric pole 2 during a closing manoeuvre of the switching device 1 (reference is made to the embodiments shown in the cited figures).

When analysing the behaviour of the aforesaid relevant electrical quantities, the above mentioned threshold voltage value can be approximated at 0V, as it is negligible with respect to the peak value of the line voltage $V_{LINE}$.

At the instant $t_0$, the movable contact 4 and the movable circuit assembly 6 are supposed to start moving towards the fixed contact 5. In this situation, the first and second conductive portions 41, 42 (and consequently the first and second assembly terminals 61, 62) are decoupled from the fixed contact 5 (third position $P_3$).

The first conductive portion 41 or the second conductive portions 42 may be coupled with or decupled from the pole terminal 17, e.g. depending on the position of the movable contact 4 and/or the shape of the first and second conductive portions 41, 42.

In any case, no load current $I_{LOAD}$ flows towards the electric load 102 as the main conduction path 300 and the auxiliary conduction path 400 are interrupted.

At the instant $t_1$, the movable contact 4 and the movable circuit assembly 6 are supposed to reach a second position $P_2$, in which the first conductive portion 41 is coupled with the fixed contact 5 and decoupled from said second pole terminal 17 and in which the second conductive portion 42 is coupled with the second pole terminal 17 and is decoupled from the fixed contact 5.

Supposing that the load voltage $V_{LOAD}$ is initially at 0V, the line voltage $V_{LINE}$ is applied between the first and second assembly terminals 61, 62. The semiconductor devices 60 switch in an ON state at the instant $t_2$ as soon as the line voltage $V_{LINE}$ becomes positive (zero crossing). At the instant $t_2$, the load current $I_{LOAD}$ starts passing through the auxiliary conduction path 400, which ensures an electrical continuity between the pole terminals 16, 17 and the load voltage $V_{LOAD}$ starts following the line voltage $V_{LINE}$ (apart from a small resistive voltage drop offered by the semiconductor devices 60 in an ON state). It is evidenced that, in this situation, the main conduction path 300 is still interrupted.

At the instant $t_3$, the movable contact 4 and the movable circuit assembly 6 are supposed to reach a first position $P_1$, in which the second conductive portion 42 is coupled with the fixed contact 5 and with the second pole terminal 17.

The first conductive portion 41 (and consequently the first assembly terminal 61) may be decoupled from the fixed contact 5 (and consequently the first pole terminal 16) or it may be still coupled with the fixed contact (and consequently the first and second assembly terminals 61, 62 are short-circuited).

In any case, the semiconductor devices 60 switch in an OFF state, as the first assembly terminal 61 is floating or short-circuited with the second assembly terminal 62. The auxiliary conduction path 400 is interrupted or short-circuited and the load current $I_{LOAD}$ passes through the main conduction path 300 as the fixed contact 5 and the second conductive portion 42 are coupled. The main conduction path 300 ensures an electrical continuity between the pole terminals 16, 17 and the load voltage $V_{LOAD}$ follows the line voltage $V_{LINE}$.

In relation to the above illustrated example, it is evident that the behaviour of the above electrical quantities (in particular of the load current $I_{LOAD}$) can vary depending of the timing of the instants $t_1$, $t_2$, $t_3$, which in turn depends on the initial instant of the closing manoeuvre, the motion law followed by the movable contact 4 and the movable circuit assembly 6 and on the position of the first and second conductive portions 41, 42 with respect to the fixed contact 5.

However, the above illustrated example shows how the semiconductor devices 60 switch at different instants $t_2$, $t_3$ during the movement of the movable contact 4 and the movable circuit assembly 6 depending on the position reached by these latter during the closing manoeuvre of the switching device 1.

Obviously, the above-mentioned electrical quantities in the electric pole 2 will behave in a similar manner when the semiconductor devices 60 are arranged with a dual configuration with respect to the configuration shown in the cited figures.

Figure 10:
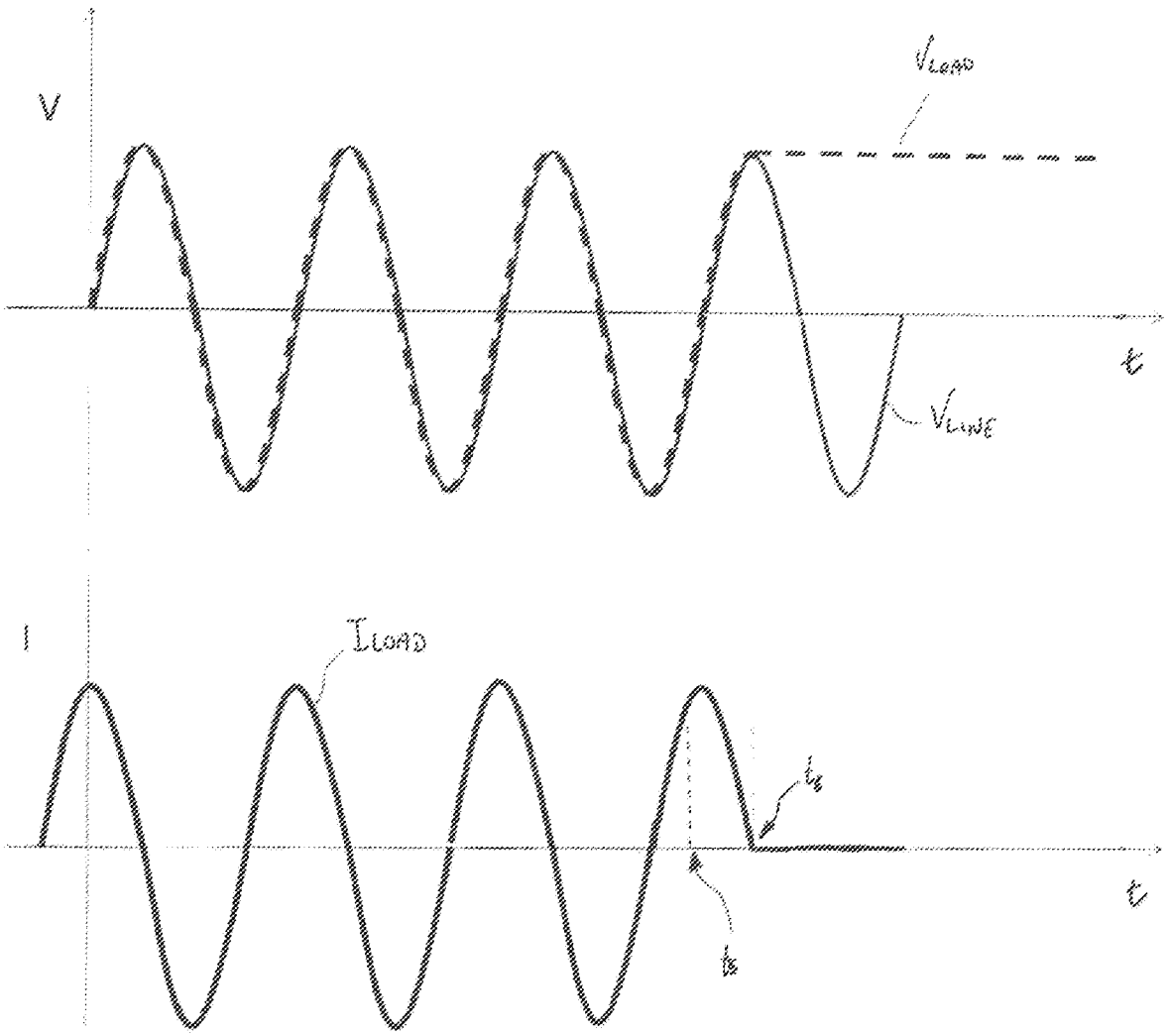

FIG. 10 schematically shows an exemplary behaviour of the electrical quantities $V_{LINE}$, $V_{LOAD}$ and $I_{LOAD}$ during an opening manoeuvre of the switching device 1 (reference is made to the embodiments shown in the cited figures).

Again, the above-mentioned threshold voltage value is approximated at 0V, as they are negligible with respect to the peak value of the line voltage $V_{LINE}$.

Before the movable contact 4 and the movable circuit assembly 6 start moving away from the fixed contact 5, the second conductive portion 42 is coupled with the fixed contact 5 and with the second pole terminal 17 (first position $P_1$).

In this situation, the semiconductor devices 60 are in an OFF state and the auxiliary conduction path 400 is interrupted or short-circuited.

The load current $I_{LOAD}$ passes through the main conduction path 300 as the second conductive portion 42 and the fixed contact 5 are coupled.

The main conduction path 300 ensures an electrical continuity between the pole terminals 16, 17 and the load voltage $V_{LOAD}$ follows the behaviour of the line voltage $V_{LINE}$.

At the instant $t_5$, the movable contact 4 and the movable circuit assembly 6 are supposed to reach a second position $P_2$, in which the first conductive portion 41 is coupled with the fixed contact 5 and decoupled from said second pole terminal 17 and in which the second conductive portion 42 is coupled with the second pole terminal 17 and is decoupled from the fixed contact 5.

The separation between the second conductive portion 42 and fixed contact 5 forces the load current $I_{LOAD}$ to pass through the semiconductor devices 60.

The semiconductor devices 60 switch in an ON state, as a positive voltage (basically due to the resistive voltage drop offered by the semiconductor devices 60) is applied between the first and second assembly terminals 61, 62.

The load current $I_{LOAD}$ starts passing through the auxiliary conduction path 400, which ensures an electrical continuity between the pole terminals 16, 17 and the load voltage $V_{LOAD}$ follows the line voltage $V_{LINE}$ (apart from a small resistive voltage drop due to the semiconductor devices 60 in an ON state).

The load current $I_{LOAD}$ stops passing through the main conduction path 300.

At the instant $t_6$, the semiconductor devices 60 switch in an OFF state as a negative voltage is provided between the first and second stack terminals 61, 62. No load current $I_{LOAD}$ flows towards the electric load 102 as the main conduction path 300 and the auxiliary conduction path 400 are interrupted (FIG. 8).

The load voltage $V_{LOAD}$ does not follow the line voltage $V_{LINE}$ anymore (it remains initially constant at the peak value of the voltage $V_{LINE}$ as the electric load 102 is supposed to be of capacitive type).

The movable contact 4 can reach the third position $P_3$, at which it is electrically decoupled from the first and second stack terminals 61, 62 and from the fixed contact 5.

In relation to the above illustrated example, it is evident that the behaviour of the above electrical quantities (in particular of the load current $I_{LOAD}$) can vary depending of the timing of the instants $t_5$, $t_6$, which in turn depends on the initial instant of the opening manoeuvre, the motion law followed by the movable contact 4 and the movable circuit assembly 6 and on the position of the first and second conductive portions 41, 42 with respect to the fixed contact 5.

However, the above illustrated example shows how the semiconductor devices 60 switch at different instants $t_5$, $t_6$ during the movement of the movable contact 4 and the movable circuit assembly 6 depending on the position reached by these latter during the opening manoeuvre of the switching device 1.

Obviously, the above-mentioned electrical quantities in the electric pole 2 will behave in a similar manner when the semiconductor devices 60 are arranged with a dual configuration with respect to the configuration shown in the cited figures.

In general, as for the above-mentioned solutions of the state of the art (e.g. the one proposed in EP2523203), the arrangement of a plurality of semiconductor devices 60, which are electrically coupleable or decoupleable with the movable contact 4 to establish or interrupt an auxiliary conduction path 400 between the pole terminals 16, 17 in parallel with the main conduction path 300, provides relevant advantages in terms of reduction of parasitic phenomena, such as the generation of electrical arcs during opening manoeuvres (when the electric power source 101 is disconnected from the electric load 102) and, on the other hand, limits possible inrush currents and transient over-voltages generated during closing manoeuvres (when the electric power source 101 electrically couples with the electric load 102).

An important aspect of the invention is however represented by the arrangement of a plurality of semiconductor devices 60 (preferably forming a compact stack structure) that can move together with the movable contact 4.

As a matter of fact, this solution provides relevant advantages in terms of reduction of the volume occupied by said semiconductor devices. As it will better emerge from the following, semiconductor devices 60 may be piled in a compact structure that can be accommodated in a suitable portion of the internal volume 20, which generally free to allow the passage of the movable contact 4. This solution allows simplifying the layout of the internal components of the electric pole 2 with respect to traditional solutions of the state of the art.

As a consequence, more space can be reserved to the semiconductor devices 60 and a smaller number of semiconductor devices 60 (e.g. power diodes), which have a larger size and capable of withstanding higher operating voltages and currents with respect to traditional solutions of the state of the art, may be employed.

The adoption of a smaller number of semiconductor devices 60 allows reducing the overall forward voltage drop across said semiconductor devices.

On the other hand, the adoption of semiconductor devices 60 with a larger size allows improving the overall current switching capabilities offer by the switching device 1.

The switching device 1 can operate at higher current levels, e.g. up to tens kA, thereby being able to withstand particularly strong in-rush currents or even being able to interrupt short-circuit currents.

Thanks to the obtaining of an optimized layout of the internal components within the electric pole 2, suitable dielectric distances can be easily maintained between live components, which decrease the probability of faults.

Additionally, live components (e.g. the movable contact 4, the fixed contact 5, the pole terminals 16, 17) can have increased dimensions, which helps withstanding high current levels.

According to a preferred embodiment, the circuit assembly 6 is arranged in such a way to be mechanically fixed to the actuation rod 9 and provide support to the movable contact 4, namely to the first and second conductive portions 41 and 42 thereof.

Preferably, the circuit assembly 6 comprises first and second conductive elements forming the first and second assembly terminals 61, 62.

Preferably, the first and second conductive elements 61, 62 are formed by conductive plates lying perpendicular to the longitudinal axis 100 of the electric pole 2.

Preferably, the first conductive element 61 is mounted on the stack of semiconductor devices 60 in such a way to sandwich this latter in cooperation with the second conductive element 62.

Preferably, the second conductive element 62 is mechanically fixed to the actuation rod 9 and it forms a support for the stack of semiconductor devices 60.

In practice, the first and second conductive elements 61, 62 are arranged at opposite ends of the stack of semiconductor devices 60 (conveniently along or in parallel with the longitudinal axis 100).

Preferably, the circuit assembly 6 comprises an insulating element 63 arranged between and mechanically coupled with the first and second conductive elements 61, 62.

Conveniently, the first and second conductive elements 61, 63 and the insulating element 63 form an enclosure accommodating the stack of semiconductor devices 60 and mechanically fixed to said actuation rod 9.

Preferably, the insulating element 63 comprises a tubular body of electrically insulating material having its opposite top and bottom ends 63A and 63B (respectively in proximal and distal position with respect to the fixed contact 5) mechanically coupled with the first and second conductive elements 61, 62 and defining, in cooperation with these latter, a volume in which the semiconductor devices 60 are accommodated.

Conveniently, the first and second conductive portions 41, 42 of the movable contact 4 are fixed on the above-mentioned enclosure at mutually spaced positions.

This solution remarkably simplifies the arrangement of the semiconductor devices 60 and the movable contact 4 in such a way that they can move together during a switching manoeuvre of the switching device.

Preferably, the first conductive portion 41 is fixed on the insulating element 63 at the top end 63A of this latter and it is electrically and mechanically coupled or forms a single piece with the first conductive element 61.

Preferably, the second conductive portion 42 is fixed on the insulating element 63 at the bottom end 63B of this latter and it is electrically and mechanically coupled or forms a single piece with the second conductive element 62.

Preferably, both the first and second conductive portions 41, 42 have a tubular shape and are fixed to an outer surface 630 of the insulating element 63 by means of suitable fixing pins 44.

Preferably, the first and second conductive portions 41, 42 have corresponding opposed edges 410, 420 separated by a spacing groove 415 extending along the outer surface 630 of the insulating element 63.

Preferably, the opposed edges 410, 420 of the first and second conductive portions 41, 42 are designed in such a way that the spacing groove 415 has an inclined profile at least extending about the longitudinal axis 100.

This solution allows a smoother commutation of the load current $I_{LOAD}$ from the auxiliary path 400 to the main conduction path 300 when the movable contact 4 and the circuit assembly 6 move from the above-mentioned coupling position $P_2$ to the above-mentioned coupling position $P_1$ (particularly when the fixed contact 5 includes a pair of overlapped contact rings 52).

Preferably, the cavity 77 formed by the conductive body 78 of the sliding connection assembly 7 is designed to accommodate at least partially the movable circuit assembly 6 and the first and second conductive portions 41, 42 of the movable contact 4 that are fixed thereon.

Conveniently, the contact rings 79 are arranged to provide a sliding electrical connection with the second conductive portion 42 and, possibly, the first conductive portion 41 depending on the position of the movable contact 4, more precisely depending on the position of the group formed by the movable circuit assembly 6 and the first and second conductive portions 41, 42.

Preferably, the cavity 53 formed by the conductive body 51 of the fixed contact 5 is designed to accommodate at least partially the movable circuit assembly 6 and the first and second conductive portions 41, 42 of the movable contact 4 that are fixed thereon.

Conveniently, the contact rings 52 are arranged to provide a sliding electrical connection with first conductive portion 41 or the second conductive portion 42 or both said conductive portions depending on the position of the movable contact 4, more precisely depending on the position of the group formed by the movable circuit assembly 6 and the first and second conductive portions 41, 42.

The above-discussed embodiments of switching device 1 may be subject to variants and modifications falling within the scope of the invention.

As an example, according to some embodiments (not shown), each electric pole may include one or more intermediate terminals arranged in such a way that in such a way that different groups of semiconductor devices switch in an ON state or in an OFF state at different instants during the movement of said movable contact, depending on the position reached by the movable contact. Additionally, some components such as the first and second conductive portions 41 and 42, the first and second conductive elements 61 and 62 and the insulating element 63 may be differently arranged in accordance with specific construction requirements of the switching device 1.

The switching device 1, according to the invention, offers remarkable advantages.

The switching device 1 shows an excellent switching efficiency and provides excellent performances in terms of reduction of parasitic phenomena during the opening/closing manoeuvres.

The switching device 1 is capable of operating even at high current levels, thereby showing improved switching performances with respect to the available switching devices of the state of the art. Differently from traditional switching devices, the switching device 1 can operate even when short-circuit currents are present. The switching device 1 can thus be used as a circuit breaker or disconnector capable of intervening even when short-circuits events affect the electric power source 101 or the electric load 102.

The switching device 1 comprises electric poles with a simplified and optimized layout of the internal components, which allows limiting overall size and reducing manufacturing costs. The switching device 1 is thus particularly simple and cheap to manufacture at industrial level.

The switching device 1 has a simple and robust structure, which is particularly adapted to be integrated in a LV or MV switchgear.

The invention claimed is:

1. A switching device for low or medium voltage electric power distribution networks, said switching device comprising one or more electric poles, each electric pole comprising:

an insulating housing extending along a longitudinal axis and fixed to a main support structure of said switching device;

a first pole terminal and a second pole terminal electrically connectable with a corresponding phase conductor of an electric power source and with a corresponding load conductor of an electric load, respectively;

a movable contact and a fixed contact, which are electrically coupleable or decoupleable one with or from another upon a movement of said movable contact towards or away from said fixed contact, said fixed contact being electrically connected with said first pole terminal, said movable contact being electrically connectable with said second pole terminal;

a movable circuit assembly including a plurality of semiconductor devices adapted to switch in a conduction state or in an interdiction state depending on the voltage applied thereto, said semiconductor devices being electrically connected in series one to another in such a way that a current can flow according to a predefined conduction direction when said semiconductor devices are in a conduction state, said movable circuit assembly comprising first and second assembly terminals for said plurality of semiconductor devices, said movable circuit assembly being operatively coupled with said movable contact and moving together with said movable contact during a movement of said movable contact towards or away from said fixed contact, said semiconductor devices switching in a conduction on state or in an interdiction state depending on the position of said movable contact and said movable circuit assembly during a switching manoeuvre of said switching device.

2. The switching device, according to claim 1, wherein said plurality of semiconductors are piled one on another to form a stack of semiconductor devices.

3. The switching device, according to claim 1, wherein said movable contact comprises a first conductive portion and a second conductive portion electrically disconnected one from another and electrically connected with said first and second assembly terminals respectively, said first and second conductive portions being electrically coupleable with or decoupleable from said fixed contact when said movable contact and said movable circuit assembly reach different positions during a switching manoeuvre of said switching device.

4. The switching device, according to claim 3, wherein during a switching manoeuvre of said switching device, said movable contact and said movable circuit assembly reach:

a first position, in which said second conductive portion is coupled with said fixed contact and with said second pole terminal;

a second position, in which said first conductive portion is coupled with said fixed contact and are decoupled from said second pole terminal and in which said second conductive portion is coupled with said second pole terminal and it are decoupled from said fixed contact;

a third position, in which said first and second conductive portions are decoupled from said fixed contact.

5. The switching device, according to claim 4, wherein during an opening manoeuvre of said switching device:

said semiconductor devices are in an interdiction state, when said movable contact and said movable circuit assembly are in said first position;

said semiconductor devices switch in a conduction state when said movable contact and said movable circuit assembly reach said second position;

said semiconductor devices switch in an interdiction state, when said movable contact and said movable circuit assembly reach said third position.

6. The switching device, according to claim 4, wherein during a closing manoeuvre of said switching device:

said semiconductor devices are in an interdiction state, when said movable contact and said movable circuit assembly are in said third position;

said semiconductor devices switch in a conduction state when said movable contact and said movable circuit assembly reach said a second position;

said semiconductor devices switch in an interdiction state, when said movable contact and said movable circuit assembly reach said first position.

7. The switching device, according to claim 2, wherein said movable circuit assembly comprises:

first and second conductive elements forming said first and second assembly terminals, said first conductive element being mounted on said stack of semiconductor devices, said second conductive element being mechanically fixed to an actuation rod of said electric pole and supporting said stack of semiconductor devices so that said stack of semiconductor devices is sandwiched between said first and second conductive elements;

an insulating element arranged between and mechanically coupled with said first and second conductive elements;

said first and second conductive elements and said insulating element forming an enclosure accommodating said stack of semiconductor devices and mechanically fixed to said actuation rod.

8. The switching device, according to claim 7, wherein said first and second conductive portions are fixed on said enclosure at mutually spaced positions; and wherein said movable contact comprises a first conductive portion and a second conductive portion electrically disconnected one from another and electrically connected with said first and second assembly terminals respectively, said first and second conductive portions being electrically coupleable with or decoupleable from said fixed contact when said movable contact and said movable circuit assembly reach different positions during a switching manoeuvre of said switching device.

9. The switching device, according to claim 8, wherein said first and second conductive portions have opposed edges separated by a spacing groove.

10. The switching device, according to claim 9, wherein said spacing groove has an inclined profile.

11. The switching device, according to claim 1, wherein said fixed contact is fixed with said first pole terminal.

12. The switching device, according to claim 1, wherein each electric pole comprises a sliding connection assembly adapted to electrically couple said movable contact with said second pole terminal during a movement of said movable contact towards or away from said fixed contact.

13. A switchgear comprising a switching device, according to claim 1.

14. The switching device, according to claim 2, wherein said movable contact comprises a first conductive portion and a second conductive portion electrically disconnected one from another and electrically connected with said first and second assembly terminals respectively, said first and second conductive portions being electrically coupleable with or decoupleable from said fixed contact when said movable contact and said movable circuit assembly reach different positions during a switching manoeuvre of said switching device.

15. The switching device, according to claim 14, wherein during a switching manoeuvre of said switching device, said movable contact and said movable circuit assembly reach:

a first position, in which said second conductive portion is coupled with said fixed contact and with said second pole terminal;

a second position, in which said first conductive portion is coupled with said fixed contact and are decoupled from said second pole terminal and in which said second conductive portion is coupled with said second pole terminal and it are decoupled from said fixed contact;

a third position, in which said first and second conductive portions are decoupled from said fixed contact.

16. The switching device, according to claim 15, wherein during an opening manoeuvre of said switching device:

said semiconductor devices are in an interdiction state, when said movable contact and said movable circuit assembly are in said first position;

said semiconductor devices switch in a conduction state when said movable contact and said movable circuit assembly reach said second position;

said semiconductor devices switch in an interdiction state, when said movable contact and said movable circuit assembly reach said third position.

17. The switching device, according to 2, wherein said fixed contact is fixed with said first pole terminal.

18. The switching device, according to 3, wherein said fixed contact is fixed with said first pole terminal.

19. The switching device, according to claim 11, wherein each electric pole comprises a sliding connection assembly adapted to electrically couple said movable contact with said second pole terminal during a movement of said movable contact towards or away from said fixed contact.

20. The switching device, according to claim 2, wherein each electric pole comprises a sliding connection assembly adapted to electrically couple said movable contact with said second pole terminal during a movement of said movable contact towards or away from said fixed contact.

* * * * *